United States Patent [19]

Rasberger et al.

[11] Patent Number: 4,692,258

[45] Date of Patent: Sep. 8, 1987

[54] TETRAHYDROQUINOLINES AS ANTIOXIDANTS FOR LUBRICANTS

[75] Inventors: Michael Rasberger, Riehen; Paul Dubs, Basel; Samuel Evans, Riehen, all of Switzerland

[73] Assignee: Ciba-Geigy Corporation, Ardsley, N.Y.

[21] Appl. No.: 810,543

[22] Filed: Dec. 18, 1985

Related U.S. Application Data

[63] Continuation of Ser. No. 742,245, Jun. 7, 1985, abandoned, which is a continuation of Ser. No. 623,630, Jun. 25, 1984, abandoned, which is a continuation of Ser. No. 557,558, Dec. 2, 1983, abandoned, which is a continuation of Ser. No. 403,696, Jul. 30, 1982, abandoned.

[30] Foreign Application Priority Data

Aug. 10, 1981 [CH] Switzerland ..... 5130/81

[51] Int. Cl.[4] ..... C10M 105/56

[52] U.S. Cl. ..... 252/50; 252/51.5 R; 546/152; 546/166; 546/178

[58] Field of Search ..... 252/50, 51.5 R; 546/166, 152, 178

[56] References Cited

U.S. PATENT DOCUMENTS

| | | | |
|---|---|---|---|
| 1,768,910 | 7/1930 | Ihrig | 252/50 |
| 2,136,788 | 11/1938 | Fairlie | 252/50 |
| 2,530,774 | 11/1950 | Kehe | 252/50 X |
| 2,647,824 | 8/1953 | Jones et al. | 252/50 X |
| 2,846,435 | 8/1958 | Harris | 260/289 |
| 2,881,061 | 4/1959 | Brennan et al. | 44/63 |
| 3,121,691 | 2/1964 | Eickemeyer | 252/50 X |
| 3,198,763 | 8/1965 | Peterli | 252/50 X |

FOREIGN PATENT DOCUMENTS

| | | |
|---|---|---|
| 55-26257 | 2/1980 | Japan . |
| 728728 | 4/1955 | United Kingdom . |

OTHER PUBLICATIONS

Smalheer et al., "Lubricant Additive", 1967, p. 7.

*Primary Examiner*—William R. Dixon, Jr.
*Assistant Examiner*—Margaret B. Medley
*Attorney, Agent, or Firm*—Luther A. R. Hall

[57] ABSTRACT

Lubricants can be rendered more resistant to oxidation with the aid of compounds of the formula I

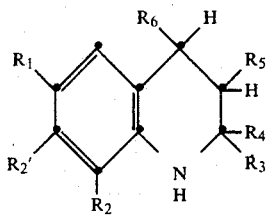

(I)

wherein $R_1$ and $R_2$ are independently hydrogen, alkyl or benzyl, $R'_2$ is hydrogen or alkyl, $R_3$ and $R_4$ are independently alkyl, phenyl or benzyl, $R_5$ is hydrogen or alkyl, and $R_6$ is alkyl. In a preferred embodiment, these compounds are combined with a customary phenolic antioxidant.

10 Claims, No Drawings

TETRAHYDROQUINOLINES AS ANTIOXIDANTS FOR LUBRICANTS

This is a continuation of application Ser. No. 742,245, filed June 7, 1985, now abandoned, which in turn is a continuation of application Ser. No. 623,630, filed June 25, 1984, now abandoned, which in turn is a continuation of application Ser. No. 557,558, filed Dec. 2, 1983, now abandoned, which in turn is a continuation of application Ser. No. 403,696, filed July 30, 1982, now abandoned.

The present invention relates to lubricants which are stabilised with the aid of quinolines.

Various additives are in general added to mineral and synthetic lubricating oils, hydraulic fluids and lubricating greases in order to improve the performance characteristics of these lubricants. There is in particular a need for additives which effectively reduce oxidation and ageing of the lubricant, and thus considerably extend the life of the lubricant.

1,2-Dihydroquinolines are known for example from the U.S. Pat. No. 3,910,918. According to this specification, these compounds can be polymerised to obtain highly-active antioxidants for polymeric plastics. It is known moreover from the Japanese Published Specification No. 55-026.257 that polymeric additives of this type can be used, in combination with phenolic antioxidants, as lubricant additives. These compounds and mixtures do not however satisfy in every respect the high demands made on a lubricant additive. Furthermore, in the U.S. Pat. No. 2,030,033 are also described hydroxylsubstituted tetrahydroquinolines as fuel additives.

It has now been found that monomeric 1,2,3,4-tetrahydroquinolines on their own, and particularly in combination with phenolic antioxidants, exhibit in lubricants an excellent antioxidation action with a satisfactory corrosion behaviour.

The present invention relates to lubricants containing a compound of the formula

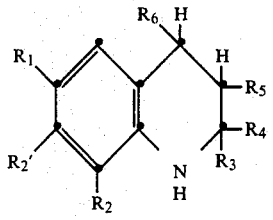

(I)

wherein $R_1$ and $R_2$ independently of one another are each hydrogen, hydroxyl, $C_1$–$C_{18}$-alkoxy, $C_3$–$C_4$-alkenyloxy, benzyloxy, $C_1$–$C_{18}$-alkyl or benzyl, $R_2'$ is hydrogen or $C_1$–$C_{12}$-alkyl, or together with $R_2$ it forms a butadienediyl group, $R_3$ and $R_4$ independently of one another are each $C_1$–$C_{18}$-alkyl, phenyl or benzyl, or $R_3$ and $R_4$ together with the carbon atom to which they are bound form a $C_5$–$C_{12}$-spiro-cycloalkyl ring, $R_5$ is hydrogen or $C_1$–$C_{18}$-alkyl, and $R_6$ is $C_1$–$C_{18}$-alkyl, or $R_5$ and $R_6$ together with the two carbon atoms to which they are bound are a $C_5$–$C_{12}$ cycloaliphatic group.

As $C_1$–$C_{18}$-alkyl, $R_1$, $R_2$, $R_3$, $R_4$, $R_5$ and $R_6$ are for example: methyl, ethyl, iso-propyl, n-propyl, n-butyl, sec-butyl, t-butyl, amyl or n-hexyl, or branched-chain or straight-chain octyl, nonyl, decyl, undecyl, dodecyl, tetradecyl, hexadecyl or octadecyl. As alkyl, $R_1$ contains preferably 1–12 C atoms, and $R_2$, $R_3$, $R_4$ and $R_6$ as alkyl are preferably $C_1$–$C_{12}$-alkyl, particularly preferably $C_1$–$C_6$-alkyl, and especially methyl or ethyl.

As $C_1$–$C_{12}$-alkyl, $R_2'$ has, within its limits, the same meanings as given by way of example above for $R_1$–$R_6$. As alkyl, $R_2'$ is preferably methyl or ethyl.

A further preferance among the meanings defined for $R_1$, $R_2$, $R_2'$ and $R_5$ is hydrogen.

When $R_1$ and $R_2$ are $C_1$–$C_{18}$-alkoxy, they are for example: methoxy, ethoxy, iso-propyloxy, n-propyloxy, n-butyloxy, sec-butyloxy, t-butyloxy, straight-chain or branched-chain hexyloxy, octyloxy, decyloxy, dodecyloxy or octadecyloxy. Methoxy and ethoxy are preferred.

As $C_3$–$C_4$-alkenyloxy, $R_1$ and $R_2$ are for example 1-propenyloxy or 1-butenyloxy.

If $R_3$ and $R_4$ together with the carbon atom to which they are bound form $C_5$ –$C_{12}$-cycloalkyl, this is for example: cyclooctyl, cyclodecyl or cyclododecyl, preferably cyclopentyl or cycloheptyl, and particularly cyclohexyl.

When $R_5$ and $R_6$ together with the two carbon atoms to which they are bound form a $C_5$–$C_{12}$-cycloaliphatic ring, they can have the meaning given above by way of example for cycloalkyl denoted by $R_3$ and $R_4$.

If $R_5$ and $R_6$ together with the two carbon atoms to which they are bound are a $C_5$–$C_{12}$-cycloaromatic ring, they can form in particular a benzene or cyclooctatetraene ring.

Preferred compounds of the formula I are those wherein $R_1$ and $R_2$ independently of one another are each hydrogen, hydroxyl, methoxy, ethoxy or $C_1$–$C_{12}$-alkyl, $R_2'$ is hydrogen, or together with $R_2$ forms a butadienediyl group, $R_3$ and $R_4$ independently of one another are each $C_1$–$C_{12}$-alkyl, or $R_3$ and $R_4$ together with the carbon atom to which they are bound form a $C_5$–$C_7$-spiro-cycloalkyl ring, $R_5$ is hydrogen and $R_6$ is $C_1$–$C_{12}$-alkyl, or $R_5$ and $R_6$ together with the two carbon atoms to which they are bound form a cyclohexane group.

Of special importance are compounds of the formula I wherein $R_1$ is hydrogen, methoxy, ethoxy or $C_1$–$C_{12}$-alkyl, $R_2$ is hydrogen, methoxy, ethoxy, methyl or ethyl, $R_2'$ is hydrogen, or together with $R_2$ it forms a butadienediyl group, $R_3$ and $R_4$ are methyl or ethyl, or $R_3$ and $R_4$ together with the carbon atom to which they are bound form a spirocyclohexyl ring, and $R_5$ is hydrogen and $R_6$ methyl or ethyl.

Examples of compounds of the formula I are:

(1) 2,2,4-trimethyl-1,2,3,4-tetrahydroquinoline,
(2) 2,2,4-trimethyl-6-n-dodecyl-1,2,3,4-tetrahydroquinoline,
(3) 2-methyl-2,4-diethyl-1,2,3,4-tetrahydroquinoline,
(4) 2,2,4,7-tetramethyl-1,2,3,4-dihydroquinoline,
(5) 2,2,4,8-tetramethyl-1,2,3,4-tetrahydroquinoline,
(6) 2,2,4,6-tetramethyl-1,2,3,4-tetrahydroquinoline,
(7) 2,2,4,6,8-pentamethyl-1,2,3,4-tetrahydroquinoline,
(8) 2,2,4-trimethyl-8-methoxy-1,2,3,4-tetrahydroquinoline,
(9) 2,2,4-trimethyl-8-methoxy-1,2,3,4-tetrahydroquinoline,
(10) 2-methyl-2,4-diethyl-6-methoxy-1,2,3,4-tetrahydroquinoline.

(11)

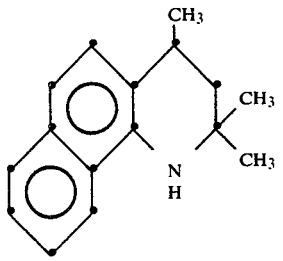

(12)

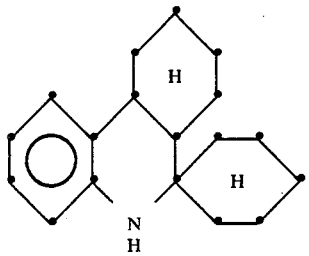

In a preferred embodiment of the invention, the quinolines to be used according to the invention are employed in combination with sterically hindered, phenolic antioxidants. Suitable phenolic antioxidants are in particular:

1. 2,6-Dialkylphenols, for example 2,6-di-tert-butyl-4-methylphenol, 2,6-di-tert-butyl-4-methoxymethylphenol or 2,6-di-tert-butyl-4-methoxyphenol.
2. Bisphenols, for example: 2,2'-methylene-bis-(6-tert-butyl-4-methylphenol), 2,2'-methylene-bis-(6-tert-butyl-4-ethylphenol), 2,2'-methylene-bis-[4-methyl-6-(α-methylcyclohexyl)phenol], 1,1-bis-(5-tert-butyl-4-hydroxy-2-methylphenyl)-butane, 2,2-bis-(5-tert-butyl-4-hydroxy-2-methylphenyl)-butane, 2,2-bis-(3,5-di-tert-butyl-4-hydroxyphenyl)-propane, 1,1,3-tris-(5-tert-butyl-4-hydroxy-2-methylphenyl)-butane, 2,2-bis-(5-tert-butyl-4-hydroxy-2-methylphenyl)-4-n-dodecylmercapto-butane, 1,1,5,5-tetra-(5-tert-butyl-4-hydroxy-2-methylphenyl)pentane, ethylene glycol-bis-[3,3-bis-(3'-tert-butyl-4'-hydroxyphenyl)-butyrate], 1,1-bis-(3,5-dimethyl-2-hydroxyphenyl)-3-(n-dodecylthio)-butane or 4,4'-thio-bis-(6-tert-butyl-3-methylphenol).
3. Hydroxybenzyl substituted aromatic compounds, for example: 1,3,5-tri-(3,5-di-tert-butyl-4-hydroxybenzyl)-2,4,6-trimethylbenzene, 2,2-bis-(3,5-di-tert-butyl-4-hydroxybenzyl)-malonic acid-dioctadecyl ester, 1,3,5-tris-(3,5-di-tert-butyl-4-hydroxybenzyl)-isocyanurate or 3,5-di-tert-butyl-4-hydroxybenzylphosphonic aciddiethyl ester.
4. Amides of β-(3,5-di-tert-butyl-4-hydroxyphenyl)propionic acid, for example: 1,3,5-tris-(3,5-di-tert-butyl-4-hydroxyphenyl)-propionyl)hexahydro-s-triazine or N,N'-di-(3,5-di-tert-butyl-4-hydroxyphenyl-propionyl)-hexamethylenediamine.
5. Esters of β-(3,5-di-tert-butyl-4-hydroxyphenyl)-propionic acid with mono- or polyhydric alcohols, for example with methanol, octadecanol, 1,6-hexanediol, ethylene glycol, thiodiethylene glycol, neopentyl glycol, pentaerythritol or tris-hydroxyethylisocyanurate.
6. Spiro compounds, for example: diphenolic spiro-diacetals or -diketals, such as 2,4,8,10-tetraoxaspiro-[5,5]-undecane substituted in the 3,9-position by phenolic groups, for example 3,9-bis-di-tert-butyl-4-hydroxyphenyl)-2,4,8,10-tetraoxaspiro-[5,5]-undecane or 3,9-bis-[1,1-dimethyl-2-(3,5-ditert-butyl-4-hydroxyphenyl)-ethyl]-2,4,8,10-tetraoxaspiro-[5,59 -undecane.

Particularly preferred phenolic compounds are:
4,4'-bis-(2,6-diisopropylphenol),
2,4,6-triisopropylphenol,
2,2'-thio-bis-(4-methyl-6-tert-butyl-phenol),
4,4'-methylene-bis-(2,6-di-tert-butyl-phenol),
1,3,5-tri-(3,5-di-tert-butyl-4-hydroxybenzyl)-2,4,6-trimethylbenzene,
pentaerythritol-tetra-[3-(3,5-di-tert-butyl-4-hydroxyphenyl)propionate],
β-(3,5-di-tert-butyl-4-hydroxyphenyl)-propionic acid-n-octadecyl ester,
thiodiethylene glycol-β-[4-hydroxy-3,5-di-tert-butylphenyl]-propionate, and
2,6-di-tert-butyl-4-methyl-phenol.

The production of compounds of the formula I is known for example from the U.S. Pat. No. 3,910,918. Where also new compounds of the formula I are involved, these likewise form subject matter of the invention, and can be produced analogously. The phenolic antioxidants optionally to be used concomitantly are also known compounds and can be produced according to known processes.

The quinolines of the formula I can be used at a concentration of 0.05–10% by weight, relative to the material to be stabilised. A preferred concentration is 0.05–5% by weight, and especially 0.1–2.5% by weight.

When according to a preferred embodiment of the present invention there are concomitantly used phenolic antioxidants, these are employed at a concentration of 0.05–5% by weight, relative to the material to be stabilised. A preferred concentration range is 0.1–2% by weight.

The ratio of the compounds of the formula I to be used according to the invention to phenolic antioxidants is 10:1 to 1:10, preferably 1:5 to 5:1, and particularly 1:3 to 3:1.

Mineral and synthetic lubricating oils, hydraulic fluids and lubricating greases which have been stabilised in the described manner have excellent lubricating properties, which are clearly manifested by a great decrease in the amount of wear on the parts to be lubricated.

The lubricants which can be used are commonly known to those skilled in the art, and are described for example in "Schmiermittel Taschenbuch" ("Lubricants Handbook") [Hüthig Verlag, Heidelberg, 1974]. Particularly suitable are for example: poly-α-olefins, lubricants based on esters, phosphates, glycols, polyglycols and polyalkylene glycols.

The lubricant formulations can additionally contain other additives which are added to improve certain performance properties, such as further antioxidants, metal passivators, rust inhibitors, agents for improving the viscosity index, pour-point depressors, dispersants/-tensides and other additives protecting against wear.

Examples of other antioxidants are:

(a) alkylated and non-alkylated aromatic amines and mixtures thereof, for example: dioctyldiphenylamine, (2,2,3,3-tetramethyl-butyl)-phenyl-α- and -β-naphthylamines, phenotriazine, dioctylphenothiazine, phenyl-α-naphthylamine and N,N'-di-sec-butyl-p-phenylenediamine;

(b) alkyl-, aryl- or alkarylphosphites, for example: trinonylphosphite, triphenylphosphite, diphenyldecylphosphite or tris-(2,4-di-tert-butylphenyl)phosphite;

(c) esters of thiodipropionic acid or thiodiacetic acid, for example: dilaurylthiodipropionate or dioctylthiodiacetate; and (d) salts of carbamic and dithiophosphoric acids, for example: antimony-diamyldithiocarbamate and zinc-diamyldithiophosphate.

Examples of metal passivators are:

(a) for copper, for example: benzotriazole, tetrahydrobenzotriazole, 2-mercaptobenzotriazole, 2,5-dimercaptothiadiazole, salicylidene-propylenediamine and salts of salicylaminoguanidine; and (b) for lead, for example, sebacic acid derivatives, quinizarine and propyl gallate.

Examples of rust inhibitors are:

(a) organic acids and esters thereof, metal salts and anhydrides, for example: N-oleoyl-sarcosine, sorbitanemonooleate, lead naphthenate and dodecenylsuccinic acid anhydride;

(b) nitrogen-containing compounds, for example:

I. primary, secondary or tertiary aliphatic or cycloaliphatic amines and amine salts of organic and inorganic acids, for example oil-soluble alkylammonium carboxylates, and II. heterocyclic compounds, for example: substituted imidazolines and oxazolines;

(c) phosphorus-containing compounds, for example: amine salts of phosphoric acid partial esters; and (d) sulfur-containing compounds, for example: barium dinonylnaphthalene-sulfonates and calcium petroleum sulfonates.

Examples of agents improving the viscosity index are, polymethacrylates, vinylpyrrolidone/methacrylate copolymers, polybutene, olefin copolymers and styrene/acrylate copolymers.

Examples of pour-point depressors are:

polymethacrylate and alkylated naphthalene derivatives.

Examples of dispersants/tensides are:

polybutenylsuccinic acid imides, polybutenylphosphonic acid derivatives, and basic magnesium, calcium and barium sulfonates and -phenolates.

Examples of additives providing protection against wear are:

compounds containing sulfur and/or phosphorus and/or halogen, such as vegetable oils treated with sulfur, zinc dialkyldithiophosphates, tritolyl phosphate, chlorinated paraffins, and alkyl and aryl disulfides.

EXAMPLE:

Oil Oxidation Test, Standard Version According to ASTM D 2272 (Rotary Bomb Oxidation Test)

The following of the above-mentioned quinolines were tested, according to ASTM D 2272, in mineral oil 'Vitrea 100 (ODX) Shell' [viscosity 10.6 $mm^2/s$ (100° C.)]. The test is finished with a drop in pressure of 172.4 KPa (25 psi). The results given in the Table which follows signify the time in minutes until the given drop in pressure has occurred. Long time values correspond to a high degree of stabiliser effectivness.

| Stabiliser No. (0.5% by weight) | Minutes until drop in pressure of 172.4 KPa |
|---|---|
| none | 29 |
| 1 | 438 |

-continued

| Stabiliser No. (0.5% by weight) | Minutes until drop in pressure of 172.4 KPa |
|---|---|
| 2 | 178 |
| 3 | 292 |
| 4 | 238 |
| 5 | 181 |
| 6 | 225 |
| 7 | 98 |
| 8 | 275 |
| 10 | 208 |
| 11 | 91 |

What is claimed is:

1. A lubricant composition, having excellent lubricating properties, which comprises (a) a mineral oil, a synthetic oil, a hydraulic fluid or a lubricating grease, and (b) 0.05 to 5% by weight, based on component (a), of a compound of formula I

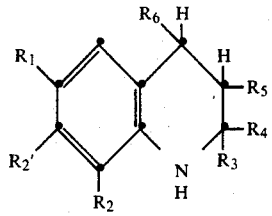

(I)

wherein $R_1$ and $R_2$ independently of one another are each hydrogen, $C_1$–$C_{18}$-alkyl or benzyl, $R'_2$ is hydrogen or $C_1$–$C_{12}$-alkyl, or together with $R_2$ it forms a butadienediyl group, $R_3$ and $R_4$ independently of one another are each $C_1$–$C_{18}$-alkyl, phenyl or benzyl, or $R_3$ and $R_4$ together with the carbon atom to which they are bound form a $C_5$–$C_{12}$-spiro-cycloalkyl ring, $R_5$ is hydrogen or $C_1$–$C_{18}$-alkyl, and $R_6$ is $C_1$–$C_{18}$-alkyl, or $R_5$ and $R_6$ together with the two carbon atoms to which they are bound are a $C_5$–$C_{12}$ cycloaliphatic group.

2. A lubricant according to claim 1, which contains a compound of the formula I wherein $R_1$ and $R_2$ independently of one another are each hydrogen, or $C_1$–$C_{12}$-alkyl, $R_2'$ is hydrogen, or together with $R_2$ forms a butadienediyl group, $R_3$ and $R_4$ independently of one another are each $C_1$–$C_{12}$-alkyl, or $R_3$ and $R_4$ together with the carbon atom to which they are bound form a $C_5$–$C_7$-spiro-cycloalkyl ring, $R_5$ is hydrogen and $R_6$ is $C_1$–$C_{12}$-alkyl, or $R_5$ and $R_6$ together with the two carbon atoms to which they are bound form a cyclohexane group.

3. A lubricant according to claim 1, which contains a compound of the formula I wherein $R_1$ is hydrogen, or $C_1$–$C_{12}$-alkyl, $R_2$ is hydrogen, methyl or ethyl, $R_2'$ is hydrogen, or together with $R_2$ it forms a butadienediyl group, $R_3$ and $R_4$ are methyl or ethyl, or $R_3$ and $R_4$ together with the carbon atom to which they are bound form a spiro-cyclohexyl ring, and $R_5$ is hydrogen and $R_6$ is methyl or ethyl.

4. A lubricant according to claim 1, which contains 2,2,4-trimethyl-1,2,3,4-tetrahydroquinoline.

5. A lubricant according to claim 1, which additionally contains a sterically hindered phenol as a further antioxidant.

6. A lubricant according to claim 5, which contains a 2,6-dialkylphenol.

7. A lubricant according to claim 5, which contains a bisphenol.

8. A lubricant according to claim 5, which contains as the hindered phenol an ester of β-(3,5-di-tert-butyl-4-hydroxyphenyl)-propionic acid.

9. A lubricant composition according to claim 5 wherein the weight ratio of the compound of formula I to the hindered phenol antioxidant is 1:10 to 10:1.

10. A lubricant composition according to claim 1 wherein the compound of formula I is 2,2,4,6-tetramethyl-1,2,3,4-tetrahydroquinoline,
2,2,4,7-tetramethyl-1,2,3,4-tetrahydroquinoline or
2-methyl-2,4-diethyl-1,2,3,4-tetrahydroquinoline.

* * * * *